US009855677B2

(12) United States Patent
Brock et al.

(10) Patent No.: US 9,855,677 B2
(45) Date of Patent: Jan. 2, 2018

(54) METHOD AND APPARATUS FOR MAKING ASPHALT CONCRETE USING AGGREGATE MATERIAL FROM A PLURALITY OF MATERIAL STREAMS

(71) Applicant: Astec, Inc., Chattanooga, TN (US)

(72) Inventors: J. Donald Brock, Lookout Moutain, TN (US); Gary L. Catlett, Hixson, TN (US); Malcolm L. Swanson, Chickamauga, GA (US)

(73) Assignee: Astec, Inc., Chattanooga, TN (US)

( * ) Notice: Subject to any disclaimer, the term of this patent is extended or adjusted under 35 U.S.C. 154(b) by 652 days.

(21) Appl. No.: 14/324,598

(22) Filed: Jul. 7, 2014

(65) Prior Publication Data

US 2015/0029809 A1 Jan. 29, 2015

Related U.S. Application Data

(60) Provisional application No. 61/859,435, filed on Jul. 29, 2013.

(51) Int. Cl.

| | |
|---|---|
| ***B28C 5/46*** | (2006.01) |
| ***E01C 19/05*** | (2006.01) |
| ***E01C 19/10*** | (2006.01) |
| ***F27B 7/20*** | (2006.01) |
| ***F27B 7/34*** | (2006.01) |
| ***F26B 11/00*** | (2006.01) |
| ***F26B 11/04*** | (2006.01) |
| ***F26B 11/12*** | (2006.01) |
| ***F26B 23/02*** | (2006.01) |
| ***F26B 25/00*** | (2006.01) |

(52) U.S. Cl.

CPC ..... *B28C 5/466* (2013.01); *E01C 19/05* (2013.01); *E01C 19/1004* (2013.01); *F26B 11/00* (2013.01); *F26B 11/0418* (2013.01); *F26B 11/0445* (2013.01); *F26B 11/12* (2013.01); *F26B 23/02* (2013.01); *F26B 25/007* (2013.01); *F27B 7/20* (2013.01); *F27B 7/34* (2013.01); *F26B 2200/08* (2013.01)

(58) Field of Classification Search

CPC ..... E01C 19/05
USPC ..... 366/7
See application file for complete search history.

(56) References Cited

U.S. PATENT DOCUMENTS

| | | |
|---|---|---|
| 3,177,932 A | 4/1965 | Smith, Jr. |
| 3,553,849 A | 1/1971 | Carrier et al. |

(Continued)

FOREIGN PATENT DOCUMENTS

| | | |
|---|---|---|
| FR | 2069059 | 9/1971 |
| KR | 2011-0047155 | 5/2011 |
| WO | WO 2010/132971 A2 | 11/2010 |

*Primary Examiner* — Tony G Soohoo
*Assistant Examiner* — Elizabeth Insler
(74) *Attorney, Agent, or Firm* — Chambliss, Bahner & Stophel, P.C.

(57) ABSTRACT

A combination of components is provided for use in making asphalt concrete from a plurality of aggregate material streams. The combination includes an indirect dryer for heating aggregate material from a first material stream without directly exposing said first stream material to hot gases of combustion. The combination also includes a mixer for mixing aggregate material from the first material stream, aggregate material that has not been heated in the indirect dryer from a second material stream, and a binder component to produce asphalt concrete.

10 Claims, 11 Drawing Sheets

(56) References Cited

U.S. PATENT DOCUMENTS

| | | | | |
|---|---|---|---|---|
| 3,777,810 | A | 12/1973 | Phillips | |
| 3,800,865 | A | 4/1974 | Onarheim et al. | |
| 3,822,651 | A | 7/1974 | Harris et al. | |
| 4,074,751 | A | 2/1978 | Ducasse | |
| 4,301,860 | A | 11/1981 | Pozzi | |
| 4,353,413 | A | 10/1982 | Allen et al. | |
| 4,482,253 | A | 11/1984 | Golobic et al. | |
| 5,090,813 | A * | 2/1992 | McFarland | E01C 19/1036 366/23 |
| 5,216,821 | A | 6/1993 | McCabe et al. | |
| 5,217,578 | A | 6/1993 | Taciuk et al. | |
| 5,320,524 | A * | 6/1994 | de Beus | B01D 45/10 432/103 |
| 5,520,342 | A * | 5/1996 | Hendrickson | E01C 19/1036 241/167 |
| 5,555,639 | A | 9/1996 | Livingston et al. | |
| 6,209,225 | B1 | 4/2001 | Villarroel et al. | |
| 6,415,527 | B1 | 7/2002 | Räsänen et al. | |
| 7,566,162 | B1 * | 7/2009 | Swanson | C08L 95/00 366/15 |
| 7,654,011 | B2 | 2/2010 | Ronning et al. | |
| 7,758,235 | B1 | 7/2010 | Collette | |
| 8,172,448 | B1 | 5/2012 | Hudman et al. | |
| 8,646,964 | B1 * | 2/2014 | Anderson | E01C 19/1004 366/7 |
| 2008/0229610 | A1 | 9/2008 | Ronning | |
| 2012/0160658 | A1 | 6/2012 | Bartek et al. | |
| 2012/0263006 | A1 * | 10/2012 | Musil | E01C 19/05 366/4 |

* cited by examiner

METHOD AND APPARATUS FOR MAKING ASPHALT CONCRETE USING AGGREGATE MATERIAL FROM A PLURALITY OF MATERIAL STREAMS

CROSS-REFERENCE TO RELATED APPLICATION

This application claims the benefit of U.S. Provisional Patent Application No. 61/859,435 which was filed on Jul. 29, 2013.

FIELD OF THE INVENTION

The present invention relates generally to the production of asphalt concrete using aggregate materials that may include recycled materials. More particularly, the present invention relates to a method and apparatus for making asphalt concrete from a plurality of aggregate material streams, each of which is processed differently, depending on its top particle size.

BACKGROUND OF THE INVENTION

Production facilities for making asphalt concrete to be used as a paving composition are well-known. Input feed materials for these facilities will include aggregate materials and asphalt cement. The aggregate materials may be provided in the form of virgin aggregate materials, and/or recycled asphalt product ("RAP") comprised of crushed asphalt concrete, and/or recycled asphalt shingles ("RAS") comprised of comminuted asphalt roofing shingles. If RAP and/or RAS is included in the input feed materials, these components will also provide an additional source of asphalt cement.

Conventional asphalt concrete production plants typically employ a rotating dryer drum having a burner at one end. Into this drum, virgin aggregate materials and/or RAP and/or RAS are introduced for heating. One end of the drum is elevated above the other, so that the input feed materials are moved along the drum from the upper end through the heated gases generated by the burner in either parallel flow (i.e., the hot gases and the material being heated move in the same direction) or counter-current flow (i.e., the hot gases and the material being heated move in opposite directions) to an outlet at the lower end. A separate mixer, such as a rotating drum mixer or a pugmill, is employed to mix the heated and dried aggregate materials with liquid asphalt cement. Another type of asphalt concrete production plant employs a dryer/mixer that dries and heats the aggregate material and also mixes it with asphalt cement. One such type of dryer/mixer is the DOUBLE BARREL® brand dryer/mixer that is sold by Astec, Inc. of Chattanooga, Tenn. This dryer/mixer includes a generally cylindrical fixed outer drum and a heating chamber comprised of a generally cylindrical inner drum that is adapted to rotate with respect to the outer drum. A burner at one end of the inner drum heats aggregate material by direct exposure to the hot gases generated, and the heated aggregate material is discharged from the inner drum into the outer drum where it is mixed with asphalt cement.

Because some conventional mixers expose liquid asphalt cement and/or RAP and/or RAS aggregate materials to the high-temperature gases used for drying and heating the aggregate materials and to the steam generated in the drying process, emissions of smoke and volatile organic components ("VOC") are stripped from the light oil fractions of the asphalt cement components. In order to prevent these emissions from being discharged to the atmosphere, it has been deemed desirable, when only virgin aggregate materials are used, to either direct the emissions into the burner for incineration, or filter the emissions from the plant exhaust gases and condense them for disposal. Even though counter-current flow is more thermally efficient than parallel flow, conventional asphalt concrete production plants that process only RAP and/or RAS are generally operated in a parallel heat flow arrangement, where the aggregate materials to be heated and dried are carried through the dryer in the same direction as the heating gases, in order to minimize smoke and VOC emissions. In addition, exposure of high proportions of RAP and/or RAS aggregate materials to the high-temperature gases used for drying and heating the aggregate materials and to the steam generated in the drying process causes oxidation of the liquid asphalt on the RAP and/or RAS, which results in degrading the asphalt and any pavement materials made with it. This reduces the number of applications for which high-RAP content or high-RAS content asphalt concrete is considered suitable.

It would be desirable if a method and apparatus for producing asphalt concrete could be provided that would limit the emission of undesirable smoke and VOC. It would also be desirable if such a method and apparatus could be provided that would be more thermally efficient than conventional systems, especially when used to process aggregate materials including RAP and/or RAS. It would also be desirable if such a method and apparatus could be provided that would minimize the oxidation of asphalt cement in high-RAP content and/or high-RAS content asphalt concrete, thereby making such products suitable for more paving applications.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

Various terms are specifically defined herein. These terms are to be given their broadest possible construction consistent with such definitions, as follows:

The term "aggregate materials" and similar terms refer to crushed stone and other particulate materials that are used in the production of asphalt concrete, such as, for example, crushed limestone and other types of crushed stone, crushed Portland cement concrete, shredded or comminuted mineral and cellulosic fibers, RAP, RAS, gravel, sand, lime and other particulate additives. The term "virgin", when applied to aggregate materials and similar terms, refers to aggregate materials that do not include asphalt cement.

The term "asphalt cement" and similar terms refer to a bituminous material that is used as a binder in various products. Asphalt cement is a component of asphalt concrete.

The terms "recycled asphalt product", "RAP" and similar terms refer to a comminuted or crushed product containing aggregate materials bound together by asphalt cement. RAP typically comprises crushed or comminuted recycled asphalt paving materials.

The terms "recycled asphalt shingles", "RAS" and similar terms refer to crushed, shredded or comminuted asphalt roofing shingles and other similar asphalt cement-containing products.

The term "asphalt concrete" and similar terms refer to a bituminous paving mixture that is produced, using asphalt cement and any of various aggregate materials, in an asphalt dryer and mixer, a combination dryer/mixer, or other asphalt concrete production plant. Asphalt concrete may be made with any of various aggregate materials or combinations thereof, and asphalt cement.

The term "downstream", as used herein to describe a relative position on or in connection with an asphalt concrete production facility or a component thereof, refers to a relative position in the direction of the movement of material through the facility or component thereof.

The term "upstream", as used herein to describe a relative position on or in connection with an asphalt concrete production facility or a component thereof, refers to a relative position in a direction that is opposite to the direction of the movement of material through the facility or component thereof.

SUMMARY OF THE INVENTION

The invention comprises a combination of components used in the production of asphalt concrete from a plurality of aggregate material streams or sources. The combination of components includes an indirect dryer for heating aggregate material from a first material stream without directly exposing said first stream material to hot gases of combustion, and a mixer for mixing aggregate material from the first material stream, aggregate material from a second material stream that has a top size which is larger than the top size of the aggregate material in the first material stream, and a binder component, to produce asphalt concrete.

In order to facilitate an understanding of the invention, the preferred embodiment of the invention is illustrated in the drawing, and a detailed description thereof follows. It is not intended, however, that the invention be limited to the particular embodiment described or to use in connection with the apparatus illustrated herein. Various modifications and alternative embodiments such as would ordinarily occur to one skilled in the art to which the invention relates are also contemplated and included within the scope of the invention described and claimed herein.

ADVANTAGES OF A PREFERRED EMBODIMENT OF THE INVENTION

Among the advantages of a preferred embodiment of the invention is that it provides a method and apparatus for producing asphalt concrete that limits the emission of undesirable smoke and VOC. Another advantage of the preferred embodiment of the invention is that it provides a method and apparatus that is more thermally efficient than conventional systems, especially those that are employed to process aggregate materials including RAP and/or RAS. Still another advantage of a preferred embodiment of the invention is a significant improvement in the asphalt concrete quality of high-RAP content and/or high-RAS content mix designs. Asphalt concrete made with high-RAP content and/or high-RAS content materials according to a preferred embodiment of the invention will be comparable in quality to asphalt concrete made with all virgin materials, due to the significant reduction in asphalt oxidation.

Other advantages and features of this invention will become apparent from an examination of the drawings and the ensuing description.

BRIEF DESCRIPTION OF THE DRAWINGS

The presently preferred embodiment of the invention is illustrated in the accompanying drawings, in which.

DESCRIPTION OF THE PREFERRED EMBODIMENT OF THE INVENTION

Figure 1:
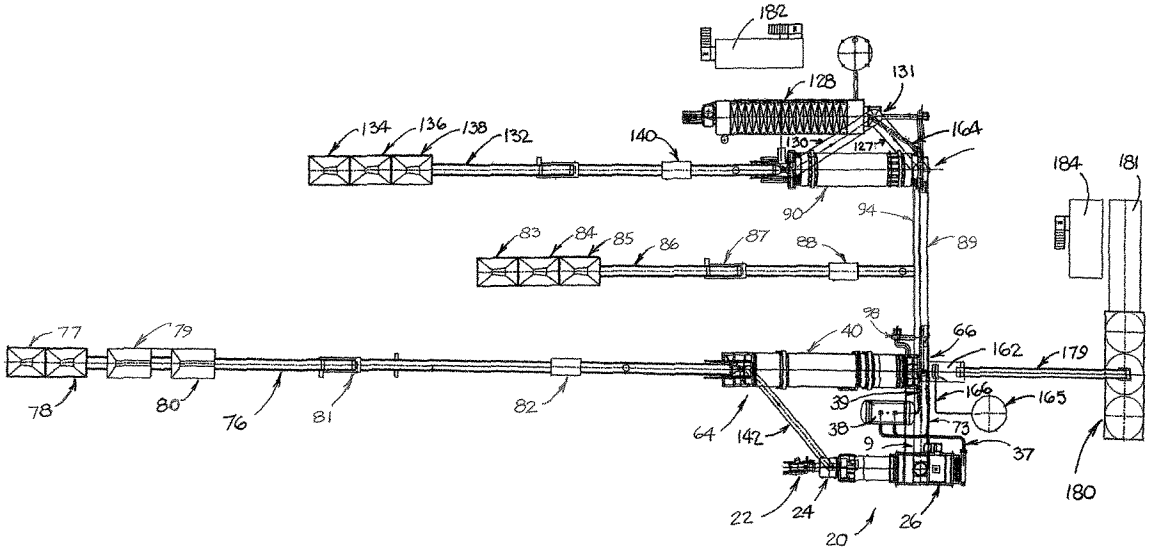
FIG. 1 is a schematic illustration of a preferred embodiment of the combination of components comprising the invention.
Figure 2:
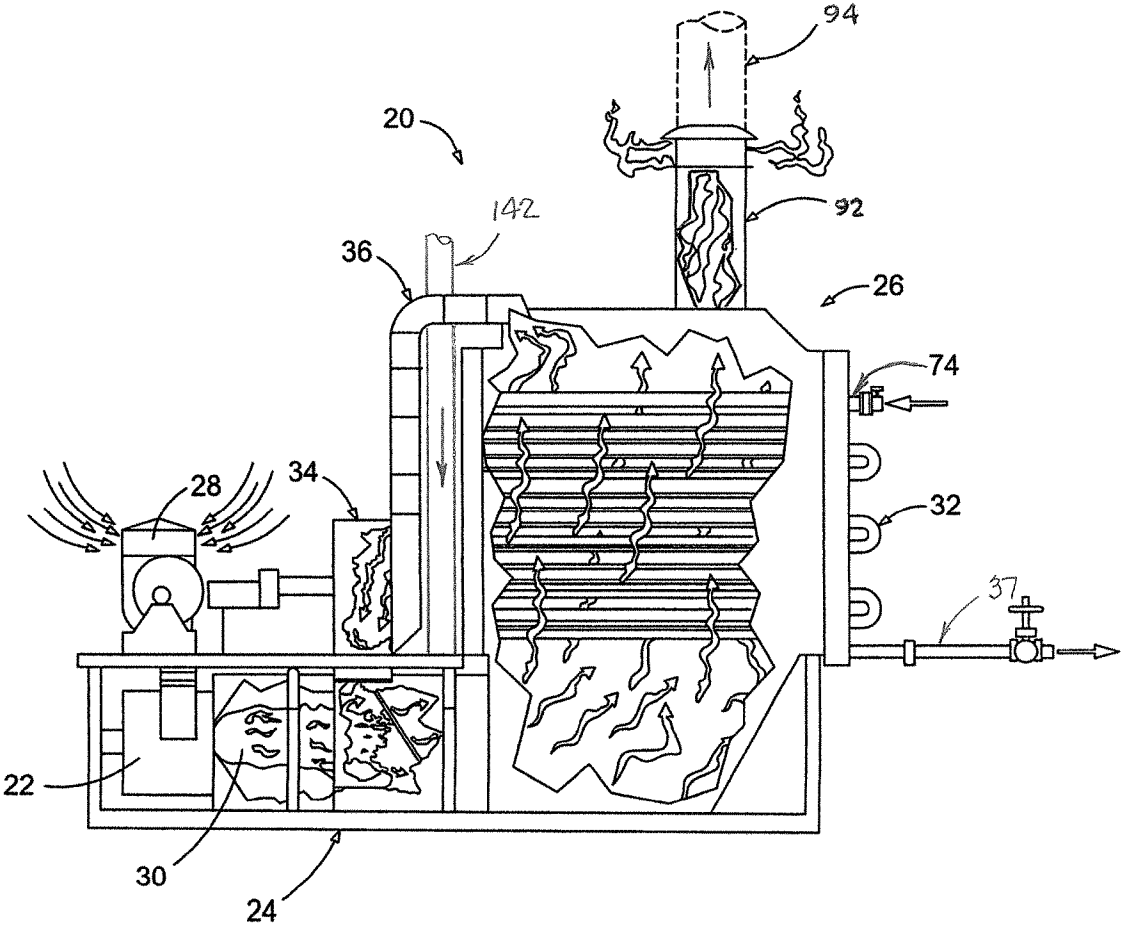
FIG. 2 is a partial sectional view of a preferred embodiment of the heating assembly that is part of the combination illustrated in FIG. 1.

A preferred embodiment of the invention is illustrated in FIG. 1. As shown therein, this preferred plant includes a heating assembly 20 comprising a burner 22 that is operatively connected to combustion chamber 24 and heat exchanger 26. As shown in FIG. 2, burner 22 is of a conventional type having air inlet 28 and is adapted to burn fuel such as natural gas, propane, pulverized coal, fuel oil or the like. Burner 22 produces flame 30 in combustion chamber 24, heating air that passes into heat exchanger 26. Heat exchanger 26 includes a plurality of heat transfer coils 32 comprising a plurality of heat transfer tubes in fluid communication with each other that are adapted to receive a thermal fluid such as thermal oil. Combustion chamber 24 is operatively connected between the burner and the heat exchanger so that air heated in the combustion chamber by the burner may be conveyed into the heat exchanger, where it will heat the thermal fluid in heat transfer coils 32. Heat exchanger 26 may be equipped with a recirculation fan (not shown) that is mounted in housing 34 and operates to draw heated air from heat exchanger 26 through recirculation duct 36 and into combustion chamber 24 for further heating. Preferably, the heating assembly will be operated to generate up to 40 million or more BTUs per hour to heat the thermal fluid within heat transfer coils 32 to a temperature of about 500° F. The preferred heating assembly is the Convectec™ heater that is manufactured and sold by Heatec, Inc. of Chattanooga, Tenn.

Hot thermal fluid is circulated between heat exchanger 26 and indirect dryer 40. Because there may be expansion of the thermal fluid as it is heated, a thermal fluid expansion system is provided in the preferred embodiment of the invention. This thermal fluid expansion system includes expansion tank 38 (see FIG. 1) and an associated pump and piping to withdraw hot thermal fluid from the heat exchanger 26 through thermal fluid transfer tube 37, and to convey it from expansion tank 38 through thermal fluid transfer tube 39 to indirect dryer 40.

Figure 3:
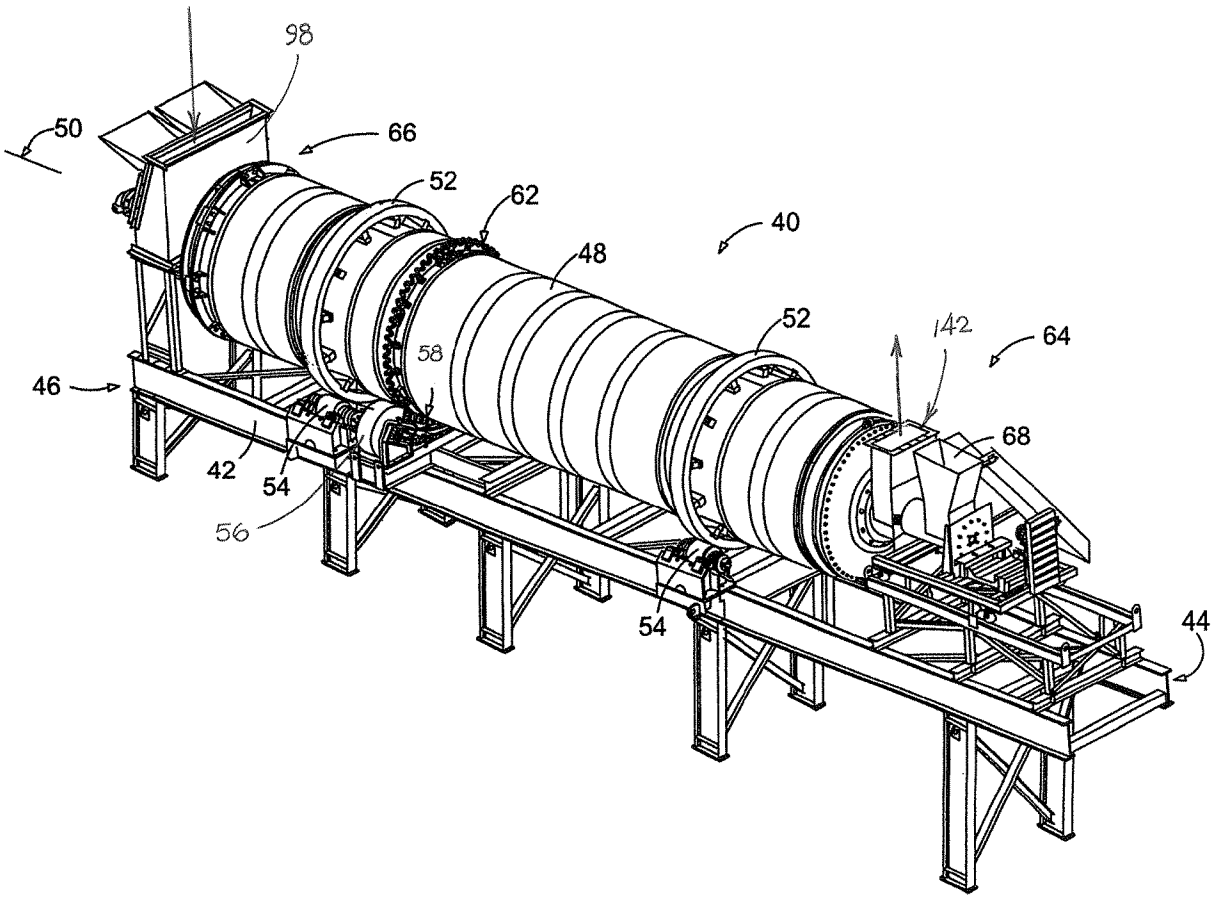
FIG. 3 is a perspective view of the indirect dryer that is part of the combination illustrated in FIG. 1.
Figure 4:
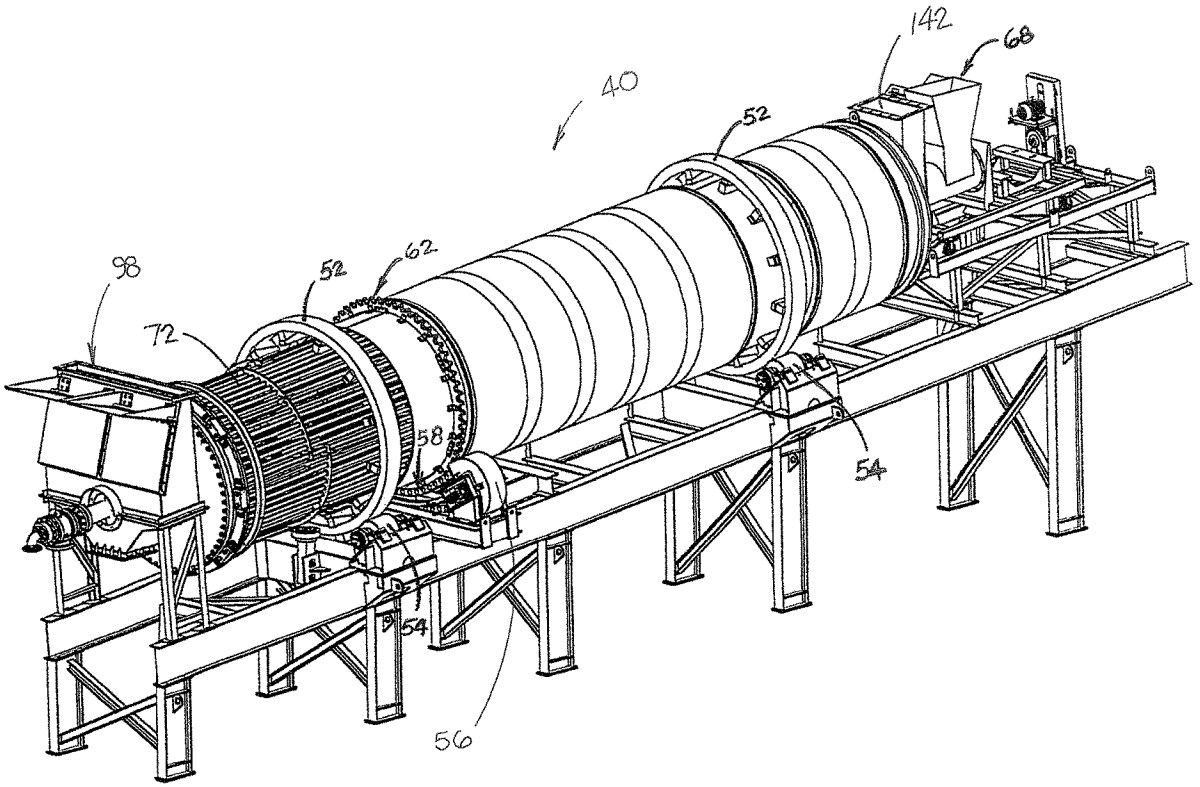
FIG. 4 is a perspective view of the indirect dryer of FIG. 3, with a portion of the outer housing of the dryer drum removed to show the thermal fluid tubes therein.
Figure 5:
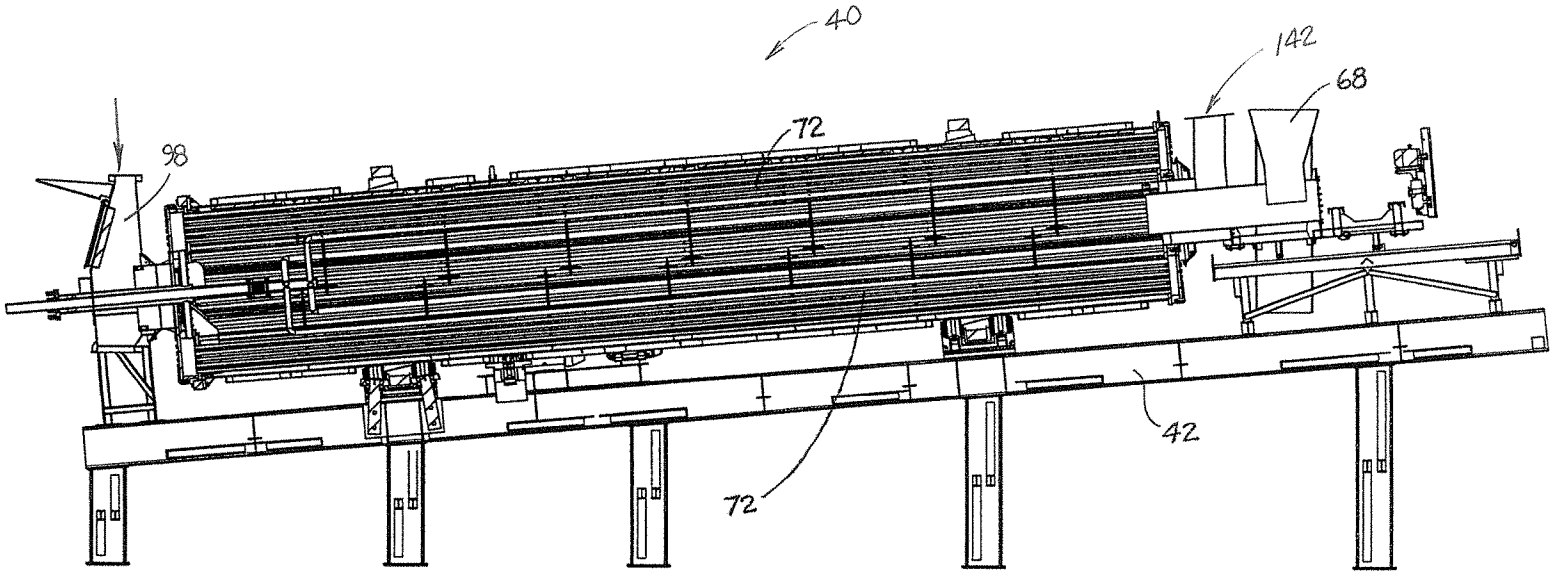
FIG. 5 is a partial sectional view of the indirect dryer of FIGS. 3 and 4, showing the thermal fluid tubes extending along the length of the dryer drum.

As shown in FIGS. 3-5, indirect dryer 40 includes dryer frame 42 having upper end 44 and lower end 46. Generally cylindrical dryer drum 48 is mounted on dryer frame 42 for rotation about axis 50. Dryer drum 48 includes a pair of outer rings 52 that engage trunnions 54 on dryer frame 42. A motor (not shown) is adapted to rotatably drive a pair of sprockets (also not shown, but one of which is enclosed within housing 56) that are connected by and in driving engagement with drive chain 58 which engages sprocket 62 mounted on the outer surface of the drum to rotate dryer drum 48 in a conventional manner. Alternative drive systems such as are known to those having ordinary skill in the art to which the invention relates may also be employed to rotate dryer drum 48 with respect to dryer frame 42.

Figure 6:
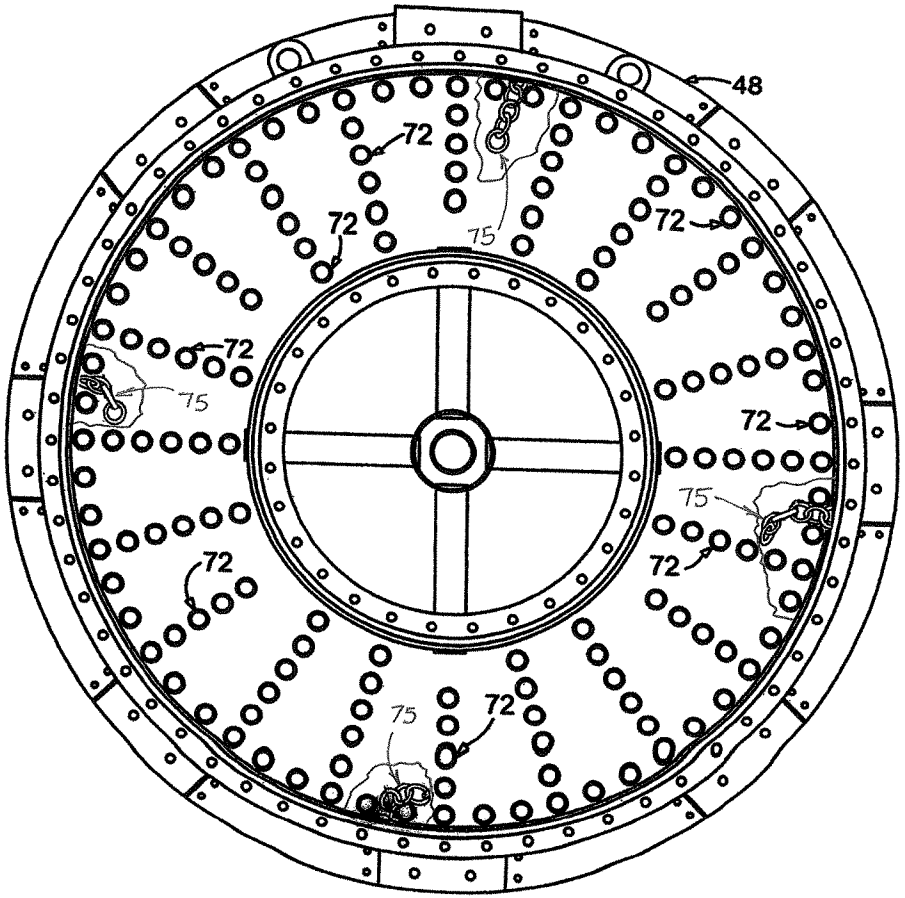
FIG. 6 is an end view of the dryer drum of FIGS. 3-5, showing the arrangement of thermal fluid tubes therein.

Because dryer drum 48 is mounted on frame 42 having a frame upper end 44 and a frame lower end 46, the axis 50 of the drum is oriented downwardly from upper end 64 of dryer drum 48 to lower end 66 of the drum. Upper end 64 of dryer drum 48 is provided with inlet 68 for material to be heated therein; consequently, upper end 64 is also the upstream end of drum 48. Dryer drum 48 is also provided with a plurality of thermal fluid tubes 72 (shown in FIGS. 4-6) that extend along the interior of the drum and are adapted to circulate thermal fluid that has been heated by heating assembly 20 through the dryer drum. Thermal fluid that has been heated in heat exchanger 26 of heating assembly 20 is conveyed from thermal fluid outlet 37 of the heat exchanger to and through expansion tank 38, and from the expansion tank through thermal fluid transfer tube 39 to indirect dryer 40, and through thermal fluid tubes 72 of dryer drum 48. Cooler thermal fluid from which heat has been extracted in indirect dryer 40 is conveyed back to heat exchanger 26 through thermal fluid tube 73 and thermal fluid inlet 74 (shown in FIG. 2) for reheating in the heat exchanger. A pump (not shown) is also included in the fluid circuit between heat exchanger 26, indirect dryer 40 and expansion tank 38, for maintaining the flow of thermal fluid therein. Heat input to indirect dryer 40 is controlled primarily by modulating the flow of hot thermal fluid to the dryer, and to a lesser extent by variation in the temperature to which the thermal fluid is heated. Since axis 50 of dryer drum 48 is tilted with respect to the ground on which frame 42 is placed, rotation of the dryer drum will cause material that is introduced into inlet 68 at upper, upstream end 64 to tumble and move downwardly towards a discharge outlet (not shown) at lower, downstream end 66. As it does so, the material will come into contact with thermal fluid tubes 72 multiple times. The rate of rotation of the dryer drum will determine the residence time of material therein, and this rate of rotation, along with the thermal fluid temperature in the heat exchanger, may be controlled to heat material in indirect dryer 40.

Preferably, thermal tubes 72 have an outer diameter of about two inches and a wall thickness of about 0.2 inches. Furthermore, they are preferably provided in such number so that they present 50-100 square feet of surface area per foot of length of the dryer drum. In one embodiment of the invention, dryer drum 48 is of such length that the plurality of thermal fluid tubes 72 extending along the interior thereof present 2500-3500 square feet of heated surface area for contact with the tumbling aggregate material, although other embodiments of the invention may have more or less total tube surface area. One embodiment of the invention may comprise a dryer drum that is 40 feet in length which is equipped with 160 thermal tubes, each of which has an outer diameter of about two inches. Such a dryer drum may have about 3000 square feet of heated surface area that is provided by the thermal tubes.

When indirect dryer 40 is used to process aggregate material including or consisting of RAP and/or RAS, it may include a cleaning system comprised of kiln chains 75 (shown in FIG. 6) or similar agitation devices that are installed in several sections of the interior of the dryer. Such chains are preferably held loosely in place so that at least a portion of them can slide around inside the dryer, wiping asphalt cement off of steel surfaces while it is still hot and liquefied to keep the inside surface of the dryer and the thermal fluid tubes located near the inside surface of the dryer clean. The number, location, length and size of the chains may be varied depending on the type of material processed. To clean the thermal fluid tubes that are more centrally located within dryer 40, clean crushed stone without any RAP or RAS could be processed through the dryer. Such aggregate could be reprocessed through the indirect dryer until it is itself coated with asphalt cement.

Figure 7:
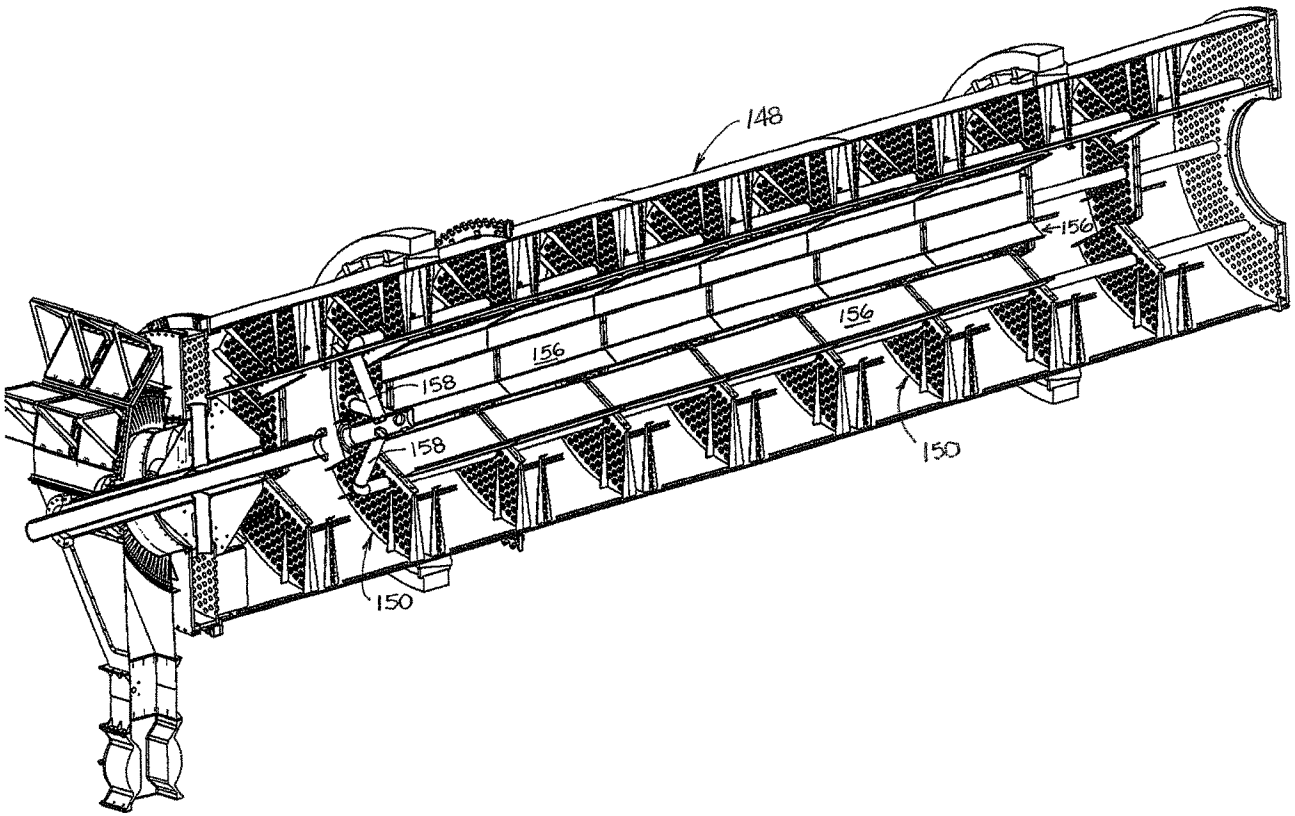
FIG. 7 is a partial sectional view of an alternative embodiment of a dryer drum that may be employed in the invention.
Figure 8:
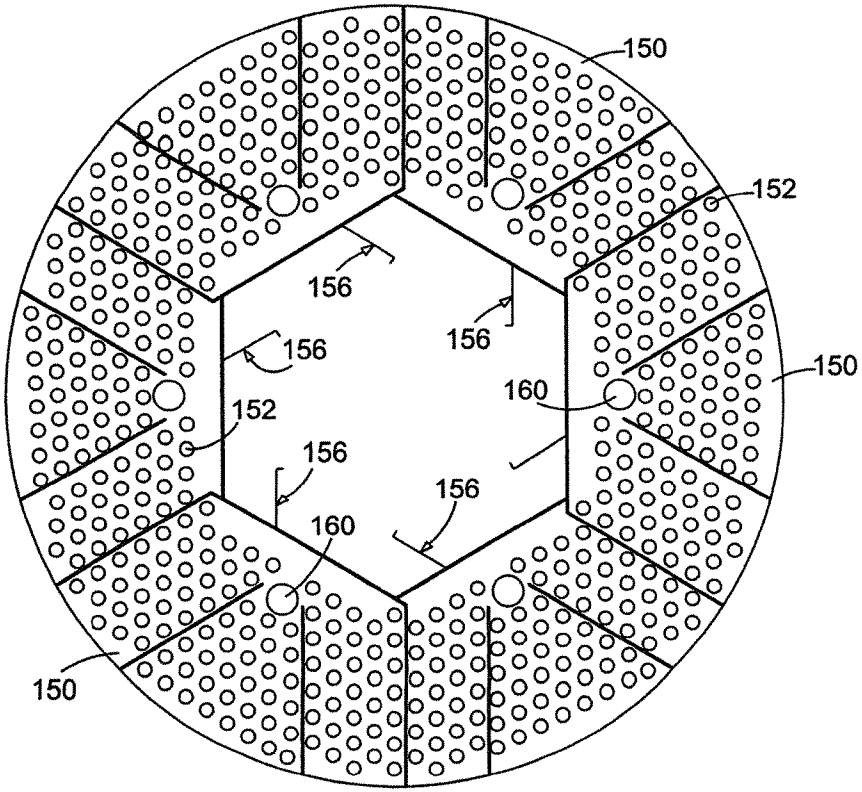
FIG. 8 is an end view of a portion of the dryer drum of FIG. 7, showing the arrangement of thermal tubes and internal flights therein.
Figure 9:
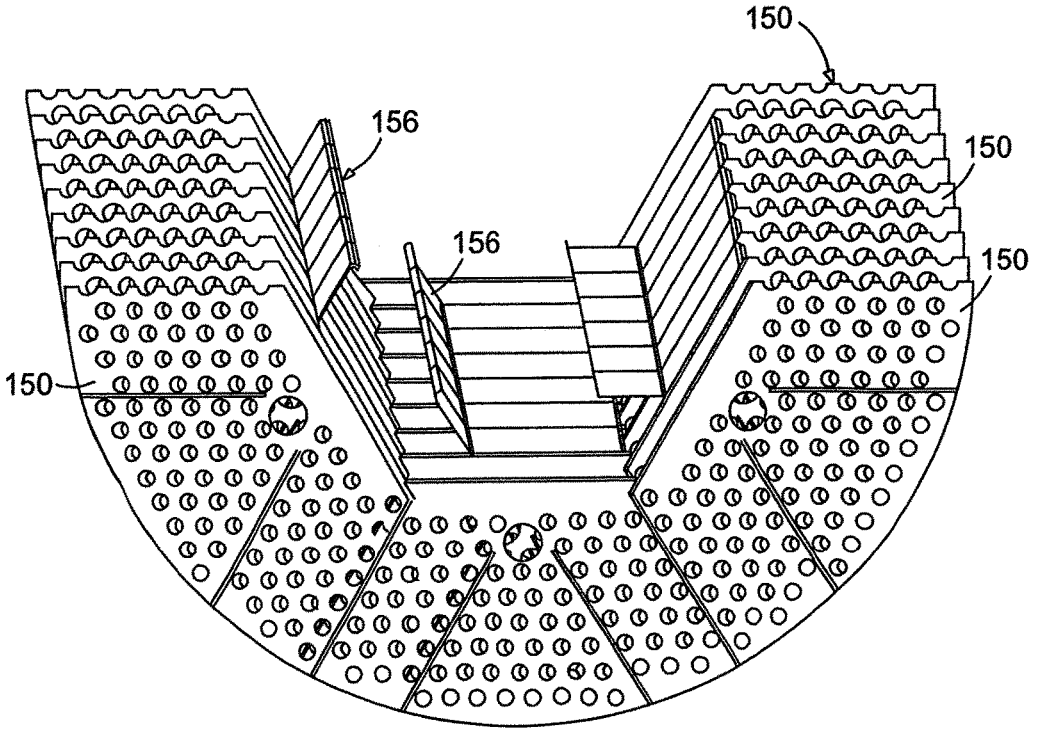
FIG. 9 is a partial perspective view of a portion of the dryer drum of FIG. 7, showing the tube support plates and the internal flights of this embodiment.

Another embodiment of the dryer drum is illustrated in FIGS. 7-9. As shown therein, dryer drum 148 is essentially identical to dryer drum 48, except that the thermal fluid tubes (not shown, but essentially identical to thermal fluid tubes 72 of dryer drum 48) are mounted through and supported by a plurality of tube support plates 150 that are spaced along the length of the dryer drum. These support plates include a plurality of tube support holes 152 that support thermal fluid tubes near the periphery of the dryer drum. Support plates 150 also support a plurality of flights or scoops 156 in the central portion of the dryer drum. These scoops 156 capture aggregate material that has spilled out of the tube bundle into the central portion of the drum, and they direct such material back into contact with the thermal fluid tubes. The thermal fluid tubes are in fluid communication with a thermal fluid manifold 158 that is supported in manifold support holes 160 in support plates 150, so that thermal fluid can be circulated through the various fluid tubes of the drying assembly.

Indirect dryer 40 is adapted to heat material containing asphalt cement and/or material having a first top size that is conveyed into inlet 68 at upstream end 64 of the dryer by conveyor 76. Storage bins 77, 78, 79 and 80 are adapted to discharge various comminuted or crushed aggregate materials having a first top size into a first stream of aggregate materials onto conveyor 76 which conveys the input material past scalping screen 81 and belt scale 82 and into indirect dryer 40. Each of storage bins 77, 78, 79 and 80 is preferably equipped with a variable speed feeder that can control the discharge of material from the bin onto conveyor 76.

Storage bins 83, 84 and 85 are provided to contain aggregate materials having a top size that is larger than the first top size, and to discharge such materials into a second stream of aggregate materials onto conveyor 86, which conveys the material past scalping screen 87 and belt scale 88 and onto conveyor 89. This second stream of aggregate materials is conveyed onto conveyor 89 without being heated in the indirect dryer. Each of storage bins 83, 84 and 85 is preferably equipped with a variable speed feeder that can control the discharge of material from the bin onto conveyor 86.

The preferred embodiment of the invention includes direct contact dryer 90, which is provided for heating aggregate material from a third material stream by directly exposing said third stream material to hot gases of combustion. In this embodiment of the invention, exhaust gases from heating assembly 20 are conducted from exhaust stack 92 of heat exchanger 26 through conduit 94 to downstream end 96 of direct contact dryer 90. A portion of these gases are conducted through recirculation circuit 98 (shown in FIG. 1) to downstream end 66 of indirect dryer 40. These exhaust gases will typically be at about 600° F. at exhaust stack 92, and may be mixed with ambient air to reduce the temperature of the gases introduced into indirect dryer 40 and direct contact dryer 90 to about 500° F. or less. Recirculation circuit 98 includes a fan (not shown) with variable frequency drive to control the rate of flow of low-oxygen hot gases from the heating assembly to the indirect dryer 40. This low-volume flow of hot gases adds a little heat to the interior of the indirect dryer and reduces the humidity therein, thereby enhancing drying efficiency in indirect dryer 40.

Figure 10:
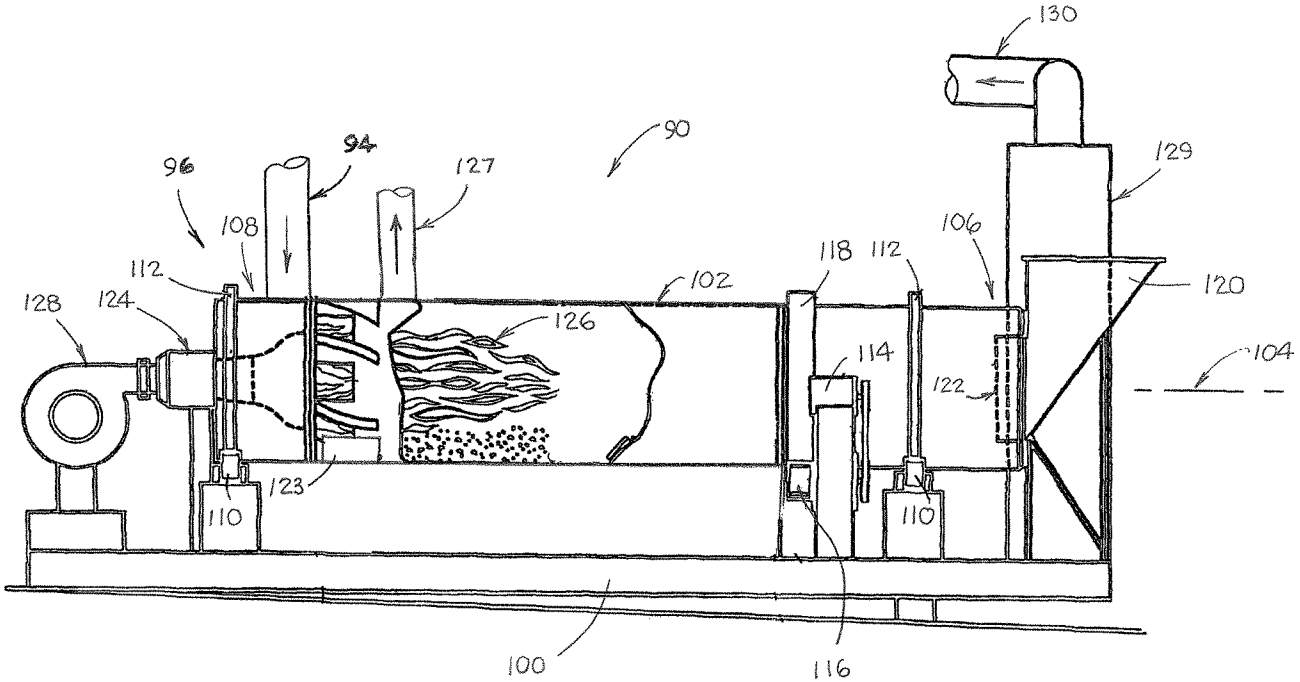
FIG. 10 is a partially cut-away side view of a direct gas contact dryer that is a part of the combination illustrated in FIG. 1.

Direct contact dryer 90 is adapted to heat virgin aggregate material or other aggregate material having a relatively larger top size than the material heated by indirect dryer 40 from a third aggregate material stream or source. The embodiment of dryer 90 shown in FIG. 10 is a counter-flow dryer such as is known to those having ordinary skill in the art to which the invention relates. Although the dryer shown in FIG. 10 is of a counter-flow design, the invention may employ any dryer that moves aggregate material along a drying drum through heated gases generated by a burner to a material outlet. Dryer 90 is supported on a frame 100 and includes a generally cylindrical drum 102 having a longitudinal axis 104 that is inclined with respect to the horizontal so that the drum has an upper end 106 and a lower end 108.

Drum 102 is rotatably mounted on frame 100 by means of bearings 110 mounted to the frame which engage races 112 located on the circumference of the drum. A motor 114 is adapted to rotatably drive a drive sprocket (not shown, but located in housing 116) that is in driving engagement with a chain drive (not shown, but located in housing 118 on the outer surface of the inner drum) to engage a sprocket (also not shown, but similar to sprocket 62 of indirect dryer drum 48) on the periphery of the drum to rotate drum 102 in a conventional manner. Alternative drive systems such as are known to those having ordinary skill in the art to which the invention relates may also be employed to rotate drum 102.

At upstream end 106 of drum 102, chute 120 provides for introduction of aggregate materials from a third material stream through inlet 122 into the drum. Due to the inclination and rotation of the drum, the aggregate materials will be conveyed from inlet 122 to outlet 123 at lower end 108 of the drum. Direct contact gas dryer 90 also includes burner 124 at downstream end 96 which is adapted to heat and dry the aggregate material within drum 102. As shown in FIG. 10, burner 124 is adapted to direct a flame 126 into the interior of the drum. Typical fuels that are burned in the burner include oil, natural gas, LP gas, and pulverized coal. Fan 128 is used to introduce a mixture of fuel and air into the burner, where the mixture is ignited to produce the flame and gases of combustion that heat and dry the aggregate materials which pass through the drum. As drum 102 rotates, a plurality of paddles or flights (not shown) mounted on the inner surface of the drum lift and tumble the aggregate materials in the drum, thereby enabling a more thorough heating and drying of the aggregate materials as they are passed through the heated gases flowing through the drum. The hot exhaust gases of combustion are directed out of the downstream end 108 of drum 102 through conduit 127 to a conventional dust filtering device such as baghouse 128, or to a cyclone separator or wet-wash system. Cooler exhaust gases from upstream end 106 of the direct contact dryer are conveyed, along with entrained dust, into plenum 129 through conduit 130 into baghouse 128. Conduit 127 and conduit 130 converge just prior to entry into the baghouse, and a diverter damper 131 is located at this intersection. Diverter damper 131 and a fan with variable frequency drive (not shown) cooperate to manage the gas flow through direct contact dryer 90, and thereby the temperature therein. Ambient air can also be introduced into the hot gas stream in either or both of conduits 127 and 130 to cool the gas stream as may be necessary to further adjust the temperature within direct contact dryer 90.

Aggregate material to be heated in direct contact dryer 90 is conveyed in a third stream into upstream end 106 of dryer 90 by conveyor 132 (shown in FIG. 1). Storage bins 134, 136 and 138 are adapted to discharge various comminuted or crushed aggregate materials having a third top size that is larger than the first top size onto conveyor 132 which conveys the input material past scalping screen 139 and belt scale 140, and into direct contact dryer 90. Each of storage bins 134, 136 and 138 is preferably equipped with a variable speed feeder that can control the discharge of material from the bin onto conveyor 132.

In preparation for introduction of aggregate materials into the preferred embodiment of the plant, virgin aggregate and/or RAP and/or RAS is crushed or comminuted and screened into discrete size fractions. Each of dryers 40 and 90 is preferably fed from two or more storage bins, each of which is loaded with material having a particular top size. It is anticipated that the top size of material from the first aggregate stream that is fed to the indirect dryer will generally be smaller than the top size of material from the second and third aggregate streams. In some applications, it is anticipated that the top size of the material fed to the indirect dryer will not exceed ⅜ inch. In other applications, the top size of the material fed to the indirect dryer may be as small as a #4 mesh size (0.187 inches). Other applications may require different top size configurations, but in general, the top size of the material fed to the indirect dryer will be smaller than the top size of aggregate materials processed from the second and third material streams. This is especially true when the aggregate material in the first material stream includes RAP or RAS.

In some embodiments of the invention, the top size of the material from the second material stream and the top size of the aggregate material from the third material streams may be the same. In other embodiments, the top sizes of aggregate materials from these two streams may be different, so long as each is larger than the top size of aggregate materials from the first material stream.

If the finer sized material includes RAP or RAS, it will include a significant quantity of asphalt cement. If such material is introduced into a hot gas stream such as is found in direct contact dryer 90, it will be heated quickly, causing the emission of VOC and smoke. However, if the finer sized material containing asphalt cement is heated indirectly, such as in indirect dryer 40, it will be heated more slowly as it tumbles down the length of dryer drum 48, and it will be less likely to produce significant emissions. Furthermore, indirect dryer 40 has a lower oxygen atmosphere than does direct contact dryer 90, because it is more tightly closed and will fill with steam that is generated from the drying process. Since oxidation is a major mechanism for deterioration of asphalt cement, a lower-oxygen atmosphere in the indirect dryer will result in a higher quality of asphalt cement component in the heated fine material. Finally, any gases that are produced in the drying process in indirect dryer 40 will be conveyed from upstream end 64 of dryer 40 through duct 142 into combustion chamber 24, where they will be destroyed in the burner flame. Finer sized material is also less abrasive than coarser sized material, so it will impart less abrasive wear to the thermal fluid tubes in indirect dryer 40 than would coarser sized material.

In contrast to the finer sized material, the coarser material will have a lower percentage of asphalt cement, and consequently, there will be fewer organic compounds to be volatilized. In addition, the coarser material, with its smaller surface area, is not heated quickly when exposed to a hot gas stream. Therefore, coarser material can be heated in direct contact dryer 90 without producing significant quantities of smoke and VOC emissions. In addition, the more abrasive coarser material will cause no abrasive wear in the direct contact dryer.

Figure 11:
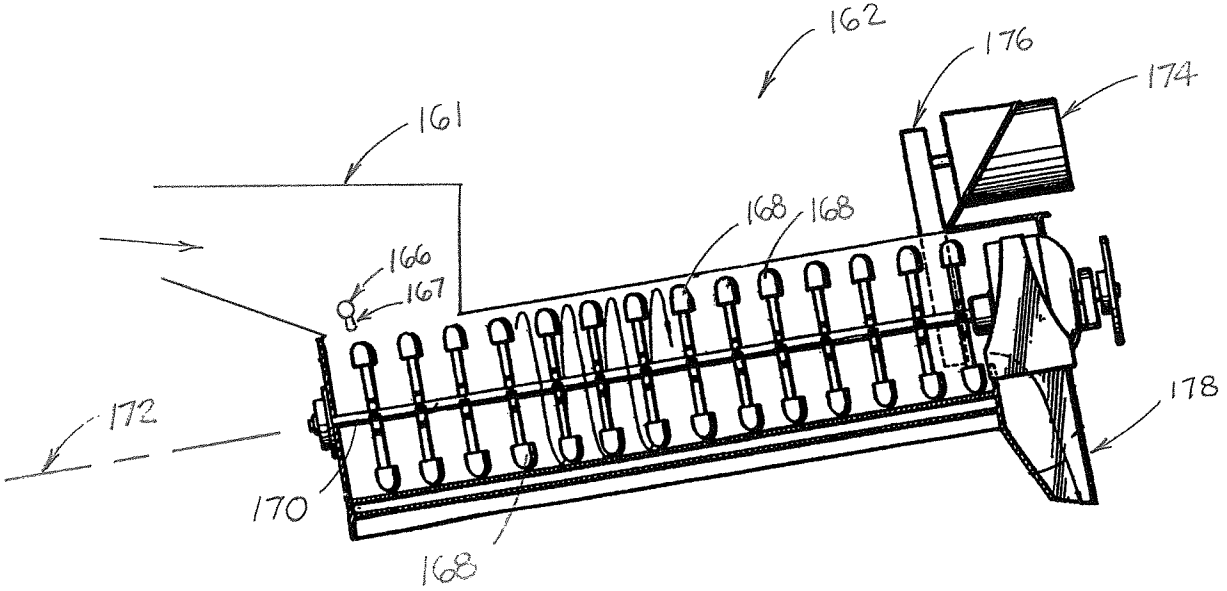
FIG. 11 is a side view, partially in section, of a mixer for mixing dried aggregate material and asphalt cement that is a part of the combination illustrated in FIG. 1.

Heated and dried material that is discharged from downstream end 66 of indirect dryer 40 is discharged directly through chute 161 (see FIG. 11) into a mixer such as pugmill 162. Material from the second stream that is not heated is transported from conveyor 86 to conveyor 89, and from conveyor 89 into pugmill 162. Furthermore, heated and dried material that is discharged from downstream end 96 of direct contact dryer 90 is transported by conveyor 89 into chute 161 for introduction into the pugmill. In a preferred embodiment of the invention, aggregate material from the first stream and aggregate material from the third stream are combined in the mixer. In this embodiment, it is also preferred that at least about 90% by weight of the material in the third stream of aggregate material, that is fed to the direct contact dryer, has a particle size that is larger than the top size of the material in the first stream of aggregate material, which is fed to the indirect dryer.

Dust that is collected in baghouse 128 is conveyed onto conveyor 89 by auger conveyor 164. The proportions of coarse and fine materials introduced into the pugmill are controlled by the relative amounts of materials entering the multiple material input streams and/or by the rate of operation of the two dryers. A binder component may be introduced into the pugmill from tank 165 or another source through supply line 166 and nozzle 167. Such binder component may comprise liquid asphalt cement and/or a rejuvenating agent for rejuvenating the asphalt cement component of RAP and/or RAS contained in the material input streams. Rejuvenating agents may comprise diesel fuel, kerosene or other hydrocarbon solvents. Pugmill 162 includes a plurality of paddles 168 that are spirally configured about shaft 170, which is mounted for rotation along axis 172. Motor 174 is provided to drive a belt or chain (not shown but contained within housing 176) to rotate shaft 170. As the shaft is rotated, aggregate material is mixed with asphalt cement and/or a rejuvenating agent and the mixture is conveyed to pugmill outlet 178. Upon discharge from the pugmill, the asphalt concrete material is transported by conveyor 179 to storage silo assembly 180 for loading into trucks. Truck scale 181 is provided for weighing the product of the production facility prior to shipment. A power center such as generator 182 provides power for operation of the plant, as controlled from control center 184. When used to process aggregate materials including RAP and/or RAS, the preferred embodiment of the invention will limit the production of smoke and VOC emissions. Furthermore, it does not require scrubbers or wet electrostatic precipitators, which makes it easier for an operator to obtain the necessary permits to operate the apparatus in populated areas. The invention will also produce high quality asphalt concrete with little oxidized asphalt cement. This offers an operator the flexibility to produce asphalt concrete for use in more paving applications. Finally, the invention is expected to be more thermally efficient than other high-RAP content and high-RAS content systems, because most such conventional systems utilize a parallel heat flow arrangement in order to limit smoke and VOC emissions. This system employs the more efficient counter-flow heat arrangement in both indirect dryer 40 and direct contact dryer 90.

The invention contemplates that aggregate material will be supplied in a first material stream for heating in an indirect dryer, and that this material will be mixed with a binder and with material from another material stream or source. It is preferred that material heated in the indirect dryer be combined with material from a third source that has been heated in the direct contact dryer. However, material that has been heated in an indirect dryer may also be combined with aggregate material from a second stream that has not been heated in an indirect dryer or with aggregate materials from a second stream and with aggregate materials from a third stream.

Although this description contains many specifics, these should not be construed as limiting the scope of the invention but as merely providing illustrations of the presently preferred embodiments thereof, as well as the best mode contemplated by the inventors of carrying out the invention. The invention, as described herein, is susceptible to various modifications and adaptations, as would be understood by those having ordinary skill in the art to which the invention relates.

What is claimed is:

1. A method of making asphalt concrete from a plurality of aggregate material streams, said method comprising:

(A) providing an indirect dryer for heating aggregate material having a first top size from a first material stream without directly exposing said first stream material to hot gases of combustion;

(B) providing a mixer for mixing:

(i) aggregate material from the first material stream that has been heated by the indirect dryer;

(ii) aggregate material, having a top size that is larger than the first top size, from a separate material stream that has not been heated by the indirect dryer; and (iii) a binder component;

to produce asphalt concrete;

(C) providing a first material stream of only aggregate material having a first top size to the indirect dryer;
(D) providing a material stream of aggregate material that is separate from the first material stream, said aggregate material in said separate material stream having a second top size that is larger than the first top size;
(E) providing a binder component;
(F) heating aggregate material from the first material stream in the indirect dryer;
(G) conveying aggregate material from the first material stream that has been heated by the indirect dryer to the mixer;
(H) conveying aggregate material from the separate material stream to the mixer;
(I) mixing:
(i) aggregate material from the first material stream that has been heated by the indirect dryer;
(ii) aggregate material from the separate material stream; and
(iii) the binder component;
together in the mixer to produce asphalt concrete.

2. The method of claim 1 wherein the first stream of aggregate material that is provided in step (C) has a top size that is within the range of 0.375-0.187 inches.

3. The method of claim 1 wherein the indirect dryer that is provided in step (A) includes:
(A) a heat exchanger including a heat transfer coil containing a thermal fluid;
(B) means for heating the thermal fluid in the heat transfer coil in the heat exchanger;
(C) an indirect dryer drum frame;
(D) an indirect dryer drum that:
(i) is adapted to rotate with respect to the indirect dryer drum frame;
(ii) includes a plurality of thermal fluid tubes that extend along the interior of the indirect dryer drum;
(iii) includes a cleaning system comprising a plurality of chains that are attached in such a way that at least a portion of each chain can slide around inside the indirect dryer drum as it is rotated with respect to the indirect dryer frame.

4. The method of claim 1:
(A) which includes the step of providing a direct contact dryer for heating aggregate material from the separate material stream by directly exposing said separate stream material to hot gases of combustion, said direct contact dryer comprising:
(i) a direct contact dryer frame;
(ii) a direct contact dryer drum that is mounted for rotation on the frame, said direct contact dryer drum having:
(iii) an upstream end having an inlet;
(iv) a downstream end having an outlet;
(v) a burner for directing heated air and gases of combustion into the direct contact dryer drum;
(B) which includes the step of conveying aggregate material from the separate material stream to the direct contact dryer;
(C) which includes the step of heating aggregate material from the separate material stream in the direct contact dryer;
(D) which includes the step of conveying aggregate material from the separate material stream to the mixer after it has been heated in the direct contact dryer.

5. The method of claim 4 wherein at least about 90% by weight of the material in the separate material stream has a particle size that is larger than the first top size.

6. The method of claim 4:
(A) which includes the step of providing a dust filtering device;
(B) wherein the direct contact dryer that is provided in step (A) includes:
(i) a hot exhaust conduit for conducting exhaust gases from the downstream end of the direct contact dryer drum to the dust filtering device;
(ii) a cooler exhaust conduit for conducting cooler exhaust gases and entrained dust from the upstream end of the direct contact dryer drum to the dust filtering device.

7. The method of claim 6:
(A) wherein the hot exhaust conduit of the direct contact dryer that is provided in step (B) converges with the cooler exhaust conduit from the upstream end of the direct contact dryer drum prior to entry into the dust filtering device;
(B) which includes the step of providing a diverter damper at the convergence of the hot exhaust conduit and the cooler exhaust conduit.

8. The method of claim 4:
(A) wherein the indirect dryer that is provided in step (A) of claim 1 includes:
(i) a heating assembly having:
(a) a burner;
(b) a heat exchanger having a heat transfer coil therein;
(c) a combustion chamber that is operatively connected between the burner and the heat exchanger so that air heated in the combustion chamber by the burner is conveyed into the heat exchanger where it heats a thermal fluid in the heat transfer coil;
(d) an exhaust stack for exhausting exhaust gases;
(ii) an indirect dryer frame;
(iii) an indirect dryer drum that is mounted for rotation on the frame, said indirect dryer drum having:
(a) an upstream end having an inlet;
(b) a downstream end having an outlet;
(c) a heat transfer tube therein that is in fluid communication with the heat transfer coil of the heat exchanger;
(B) which includes the step of providing a heating assembly exhaust conduit for conducting exhaust gases from the heating assembly of the indirect dryer to the downstream end of the direct contact dryer drum.

9. The method of claim 8 which includes providing a recirculation circuit that is in fluid communication with the heating assembly exhaust conduit, said recirculation circuit being adapted to conduct a portion of the exhaust gases from the heating assembly exhaust conduit to the downstream end of the indirect dryer drum.

10. The method of claim 4 which includes:
(A) the step of providing a mixer for mixing:
(i) aggregate material from the first material stream that has been heated by the indirect dryer;
(ii) aggregate material from second and third material streams that are separate from the first material stream, each of which second and third material streams being comprised of aggregate material:
(a) having a top size that is larger than the first top size;
(b) which has not been heated by the indirect dryer; and
(iii) a binder component;
to produce asphalt concrete;

(B) which includes the step of providing aggregate material from the second material stream to the mixer, which second material stream is not heated;

(C) which includes the step of providing aggregate material from the third material stream to the direct contact dryer;

(D) which includes the step of heating aggregate material from the third material stream in the direct contact dryer;

(E) which includes the step of conveying aggregate material from the third material stream to the mixer after it has been heated in the direct contact dryer;

(F) which includes the step of mixing:

(i) aggregate material from the first material stream that has been heated by the indirect dryer;

(ii) aggregate material from the second material stream that is not heated;

(iii) aggregate material from the third material stream that has been heated by the direct contact dryer; and (iv) the binder component;

together in the mixer to produce asphalt concrete.

* * * * *